US006424261B1

(12) United States Patent
Williams et al.

(10) Patent No.: US 6,424,261 B1
(45) Date of Patent: Jul. 23, 2002

(54) SENSOR SYSTEMS

(75) Inventors: Philip Elphee Williams; Peter John Jones, both of Swanage; Peter Jonathan Hutcheson, Exmouth, all of (GB)

(73) Assignee: Staplethorne Xtra Sense Limited, Devon (GB)

( * ) Notice: Subject to any disclaimer, the term of this patent is extended or adjusted under 35 U.S.C. 154(b) by 0 days.

(21) Appl. No.: 09/817,557

(22) Filed: Mar. 26, 2001

(51) Int. Cl.[7] ..... G08B 13/14

(52) U.S. Cl. ..... 340/568.8; 340/568.1; 340/686.1; 340/686.6; 340/687; 340/689; 340/665; 340/668

(58) Field of Search ..... 340/568.1, 568.8, 340/686.1, 687, 684, 686.6, 665, 668

(56) References Cited

U.S. PATENT DOCUMENTS 3,582,692 A * 6/1971 Palini ..... 310/8.5
3,760,402 A * 9/1973 Magerle et al. ..... 340/280
4,458,241 A * 7/1984 Frankenberg ..... 340/571
4,710,646 A * 12/1987 Curda et al. ..... 307/116
5,258,743 A * 11/1993 Nelson et al. ..... 340/568
5,638,049 A * 6/1997 Arakawa ..... 340/568

* cited by examiner

*Primary Examiner*—Jeffery Hofsass
*Assistant Examiner*—Tai T. Nguyen
(74) *Attorney, Agent, or Firm*—Melvin I. Stoltz

(57) ABSTRACT

A sensor system is provided for use in detecting movement of an item, e.g. a picture 16, suspended from a wall or other substantially vertical structure, or for detecting movement of an item displayed or stored on a horizontal or inclined surface, the sensor system including a piezoceramic element (22) which is mounted on a metallic disc (23) which, in use, is located between the item (16) and the structure or surface, and means for detecting the generation of an output by the piezoceramic element (22) as a result of deflection of the disc (23) in either of two opposite directions as a result of movement of the item (16).

11 Claims, 7 Drawing Sheets

FIG 6
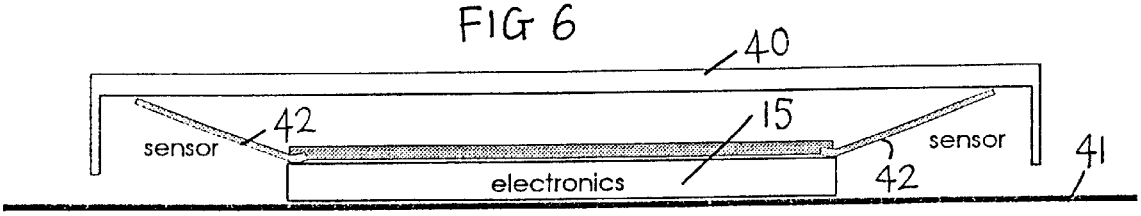
Section A - A
Arrangement for
Horizontal Applications
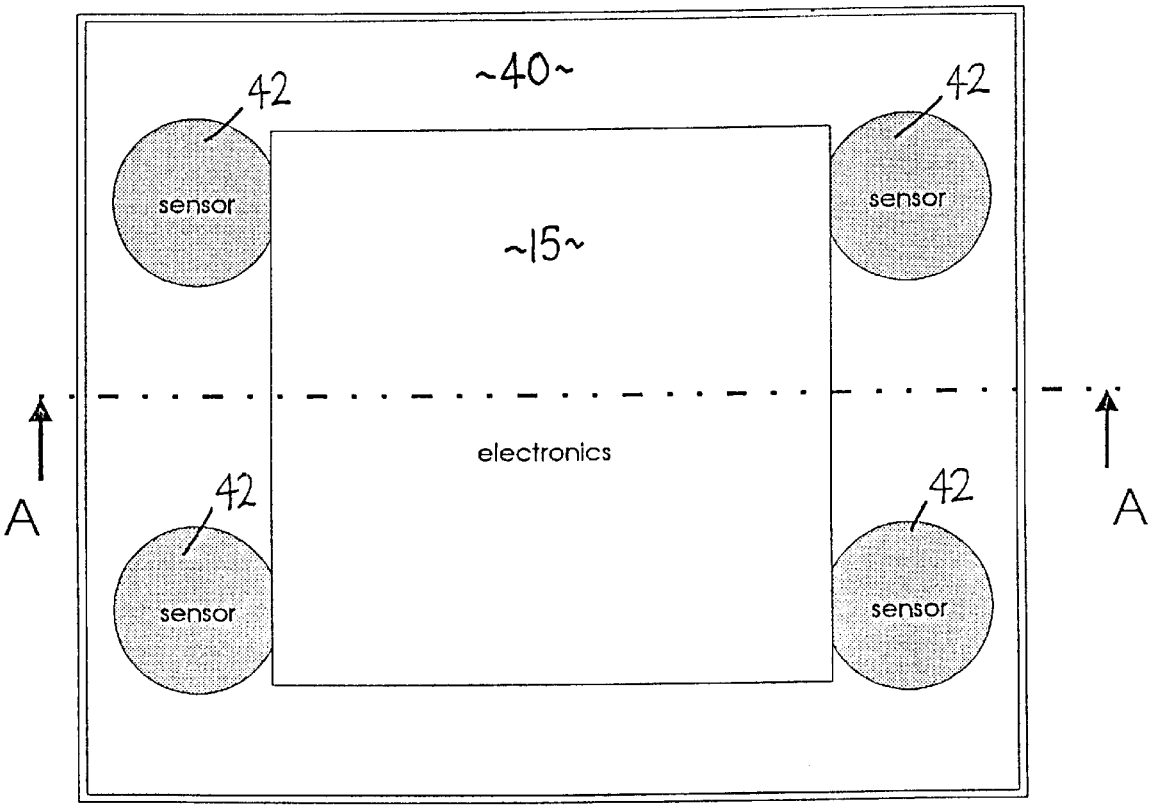
FIG 7 View from Below
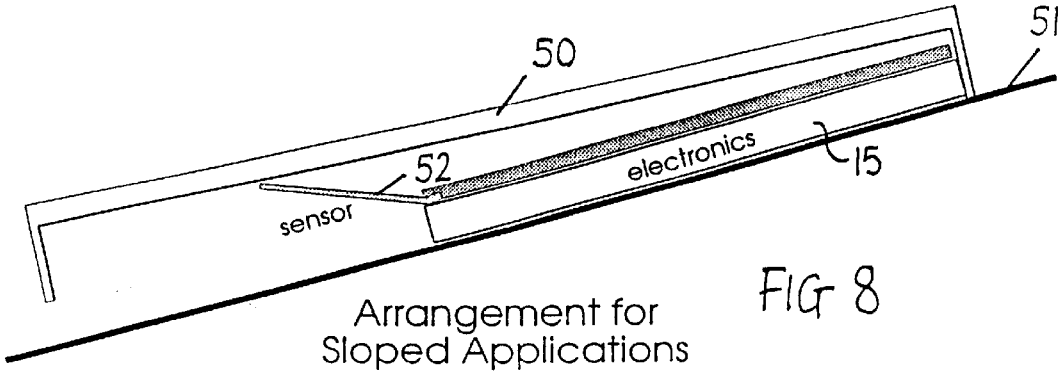
FIG 8
Arrangement for
Sloped Applications

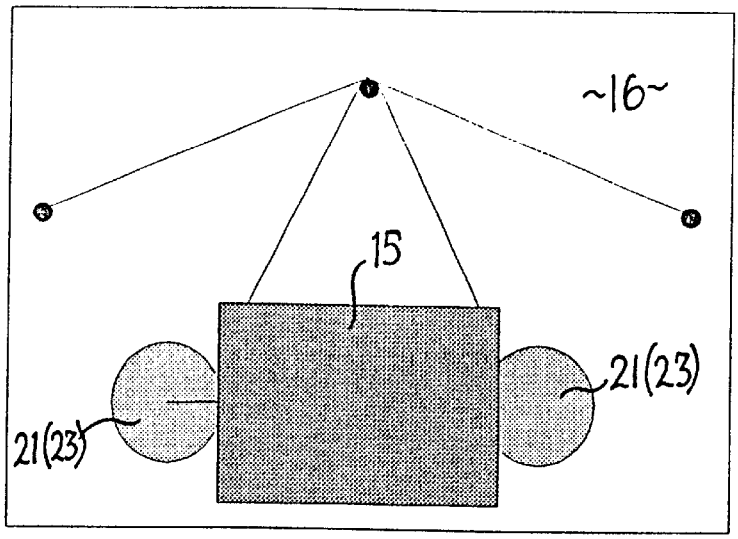
FIG 11a)
View from behind painting
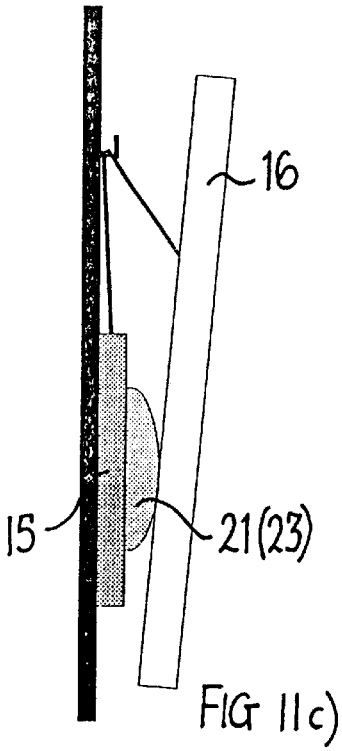
FIG 11c)
View from the side of painting
FIG 11b)
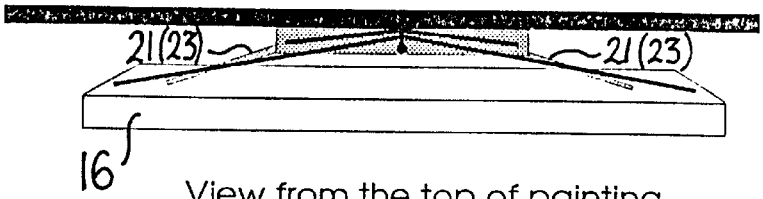
View from the top of painting View from behind painting View from the side of painting View from the top of painting

SENSOR SYSTEMS

FIELD OF THE INVENTION

This invention relates to sensor systems and to security alarms which incorporate sensor systems.

In British Patent Specification No. 2 306 035, to which reference should be made, there is described a support system for a shelf or similar surface on which one or more articles can be placed, the system including one or more piezoelectric devices for partially or wholly supporting the weight of the shelf or similar surface, and means whereby an output voltage will be generated proportional to the change of weight when objects are placed on or taken from the shelf or similar surface.

It is an object of the present invention to provide a sensor system which can be used to detect the attempted theft or damage of items displayed or stored by hanging them on walls, partitions or similar substantially vertical structures, as opposed to items which are displayed by placing them on shelves or similar substantially horizontal structures.

It is another object of the present invention to provide an improved sensor system which can be used to detect the attempted theft of, or tampering with, small and lightweight items displayed or stored on horizontal or inclined surfaces.

It is a further object of the present invention to provide a sensor system which includes improved means for filtering out the effects of environmental disturbances, such as vibration and wind-induced movement.

SUMMARY OF THE INVENTION

According to a first aspect of the present invention there is provided a sensor system for use in detecting movement of an item suspended from a wall or other substantially vertical structure, or for detecting movement of an item displayed or stored on a horizontal or inclined surface, the sensor system including a piezoceramic element which is mounted on a plate which, in use, is located between the item and the structure or surface, and means for detecting the generation of an output by the piezoceramic element as a result of deflection of the plate in either of two opposite directions as a result of movement of the item.

The plate may have a first edge portion which is attached to a mounting and is bent out of the plane of the remainder of the plate, the plate being positioned so that a second edge portion, diametrically opposite to the first edge portion, is in contact with the item, for example, adjacent the lower edge of an item in the case of an item suspended from a wall or other substantially vertical structure.

The arrangement is thus such that, in use, the weight of a painting or other item suspended from the wall or other substantially vertical structure will create a small degree of deflection of the plate. Pressing the painting or other item towards the structure will alter the degree of deflection and thus generate an output, while moving the painting or other item away from the structure will also alter the degree of deflection and generate an output.

The same effect will be obtained if an attempt is made to move an item displayed or stored on a horizontal or inclined surface.

The plate may alternatively be in the form of a brass or other metal disc which is attached at its one edge to a mounting and has its diametrically opposite edge in engagement with a pad fixed to or in contact with the item, with the arrangement such that the disc is caused to deflect and an output is generated by the piezoceramic element in response to movement of the item in either direction.

In a further alternative arrangement, the disc is mounted on a resiliently deformable metal strip or plate, for example, a spring steel strip, such that a part of the strip, typically an end of the strip, is in contact with the item, with the arrangement such that the strip is caused to deflect (and will transmit such deflection to the disc) in response to movement of the item in either direction and an output will be generated by the piezoceramic element.

According to a second aspect of the present invention there is provided a sensor system for detecting movement of an item suspended from a wall or other substantially vertical structure, the sensor system including a piezoceramic element fixed to one side of a plate and a permanent magnet fixed to the other side of the plate.

The plate is preferably in the form of a brass or other metal disc that is mounted within a housing in such manner that the periphery, or a portion of the periphery, of the disc is clamped while the centre portion of the disc is free to move.

The piezoceramic element is preferably in a pre-stressed state when the sensor system is fitted to the item being protected.

According to a third aspect of the present invention there is provided a security alarm system which includes a sensor system as defined above for generating an output, a processing circuit for processing the output from the sensor system, and an alarm, the processing circuit including a slew rate limited anti-vibration low pass filter for differentiating between true alarm and false alarm signals.

Any suitable form of alarm may be employed. For example, it may be an audible siren, a radio or infra red transmitter, or a relay which changes the state of a switch in an external circuit.

The slew rate limited anti-vibration low pass filter is preferably arranged to filter out signals which have a duration less than a predetermined length of time and is preferably arranged in series with a pulse stretcher to ensure that the length of time for which the alarm is operated is greater than the length of time for which an output is generated by the slew rate limited anti-vibration low pass filter.

The arrangement may be such that, for example, signals having a duration of less than one second are filtered out by the slew rate limited anti-vibration low pass filter. Normal filters are amplitude dependent. The slew rate limited anti-vibration low pass filter is, however, not amplitude dependent.

The alarm may form part of a unit which, in the case of a wall-hung item, is located between the item and the wall. Alternatively, the alarm may be at a remote location with a signal transmitted to the alarm by means of an induction loop device.

BRIEF DESCRIPTION OF THE DRAWINGS

FIG. 6 is a sectional view of a sensor installed beneath an item displayed or stored on a horizontal supporting surface, FIG. 7 is an underneath plan view of the arrangement shown in FIG. 6, which is a section along the line A—A of FIG. 7, FIG. 8 is a sectional view of a sensor installed beneath an item stored or displayed on an inclined surface.

DESCRIPTION OF THE PREFERRED EMBODIMENTS

Figure 1:
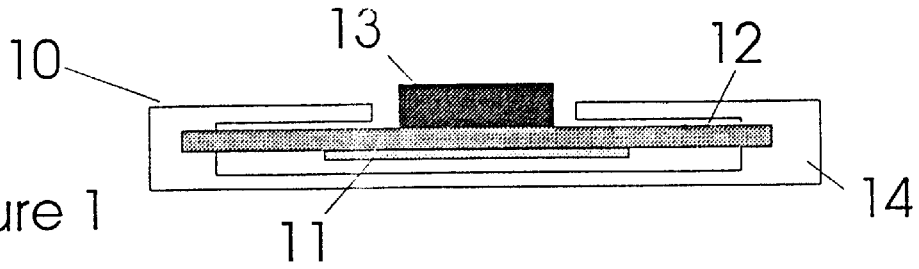
FIG. 1 is a sectional view of a first form of sensor.
Figure 1A:
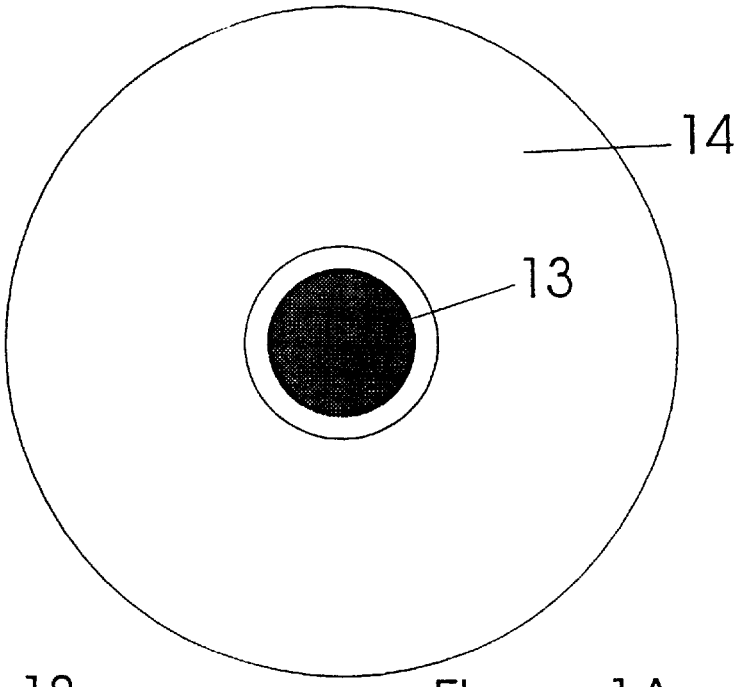
FIG. 1A is a plan view of the sensor shown in FIG. 1.

The sensor 10 shown in FIGS. 1 and 1A includes a piezoceramic element 11 fixed to one side of a disc 12 of brass or some other elastically deformable material. A permanent magnet 13 is fixed to the centre of the opposite side of the disc 12 and the disc 12 is fitted into a housing 14 that includes clamping elements (not shown) for clamping the edge of the disc 12, leaving the centre of the disc 12 free to move. The sensor is connected to an electronic control circuit 15 (shown in detail in FIG. 5) by means of flexible leads.

Figure 2:
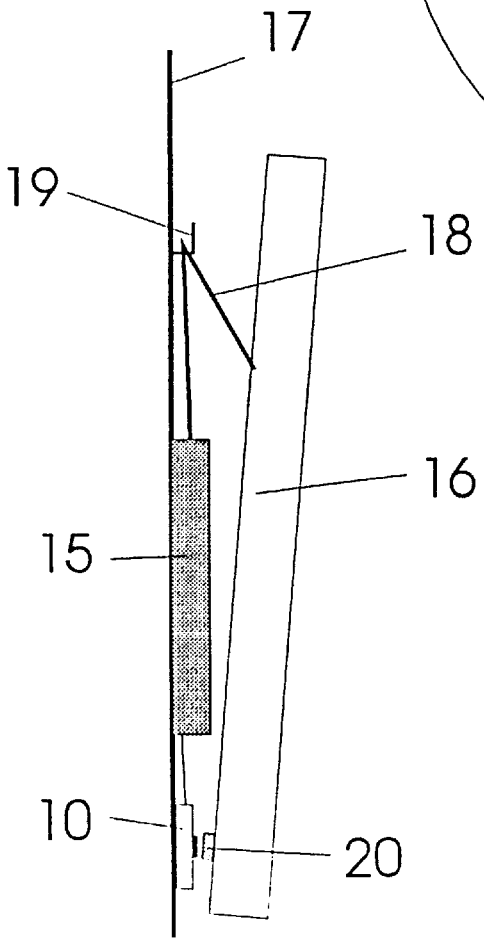
FIG. 2 shows the sensor of FIGS. 1 and 1A installed behind a painting.

In use, as shown in FIG. 2, the sensor 10 is positioned between a picture frame 16 (or other hung item) and a wall 17 from which the picture frame 16 is suspended by means of a cord 18 which fits over a hook 19. The permanent magnet 13 is arranged so that it attaches itself to a small ferrous-based item 20 fixed to or incorporated in the picture frame 16. The item 20 can be a small screw, washer, staple, or length of wire.

If pressure is applied to the picture frame 16 to press it against the wall 17, such pressure will produce deflection of the piezoceramic element and hence generation of an output signal which will be received by the electronic control circuit 15. If, on the other hand, an attempt is made to pull the picture frame 16 away from the wall 17, this will cause the permanent magnet 13 to break contact with the ferrous item 20 on the frame 16 and create a sufficiently large deflection of the piezoceramic element 11 to induce an output voltage pulse to activate an alarm (as described below).

The design of the sensor system is such that it uses the attraction between the permanent magnet 13 and the ferrous item 20 to amplify the change in the strain in the piezoceramic element 11 when the bond between the magnet 13 and the ferrous item 20 is broken, and hence produce a sufficiently large output signal for transmission to the electronic control circuit 15.

External disturbances, such as vibration and wind-induced movement, are taken up by the flexible leads, as well as being filtered out by the electronic control circuit 15 (as described below) to avoid or reduce false alarms.

Figure 3:
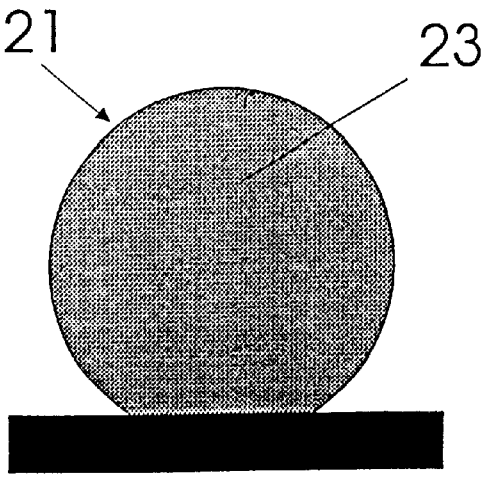
FIG. 3 is a front view of a second form of sensor.
Figure 3A:
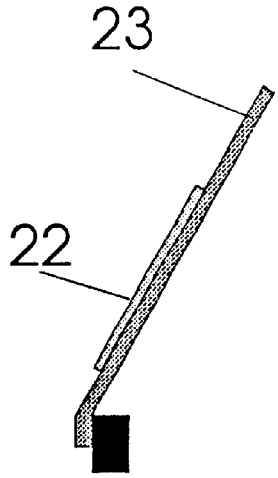
FIG. 3A is a side view of the sensor of FIG. 3.

The sensor 21 shown in FIGS. 3 and 3A comprises a piezoceramic element 22 fixed to one side of a disc 23 of brass or some other elastically deformable material. One edge of the disc 23 is bent so that it is inclined to the main body portion of the disc 23, as shown in FIG. 3A, and is connected to the electronic control circuit 15.

Figure 4:
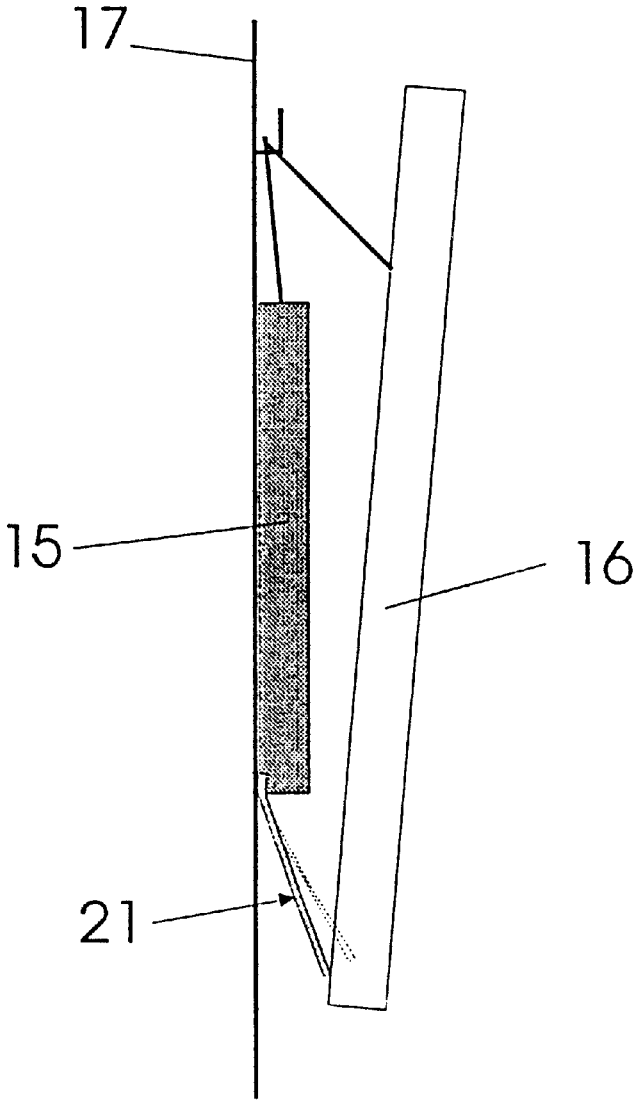
FIG. 4 shows the sensor of FIGS. 3 and 3A installed behind a painting.

In use, as shown in FIG. 4, the edge of the disc 23 rests against the frame 16 or against the rear of the painting or other hanging item, the weight of which results in the application of sufficient force to the disc 23 to produce a small deflection of the disc 23, as indicated in FIG. 4. Pressing the frame 16 or the painting against the wall 17 will increase the deflection and cause the sensor 21 to send a signal to the electronic control circuit 15 to generate an alarm signal. Equally, if the painting or the frame 16 is moved away from the wall 17, the elasticity of the material of the disc 23 will return the sensor 21 to its undeflected condition and, in the process, will produce an output to initiate the alarm signal.

The sensor system shown in FIGS. 3, 3A and 4 is thus based on pre-stressing the piezoceramic element 22 and it is the relief of this stress (or an increase in the stress) that generates a sufficiently large output signal to the electronic control circuit 15. The effects of vibration and wind-induced movement are filtered out by the electronic control circuit 15 (as described below) to avoid false alarms.

Figure 5:
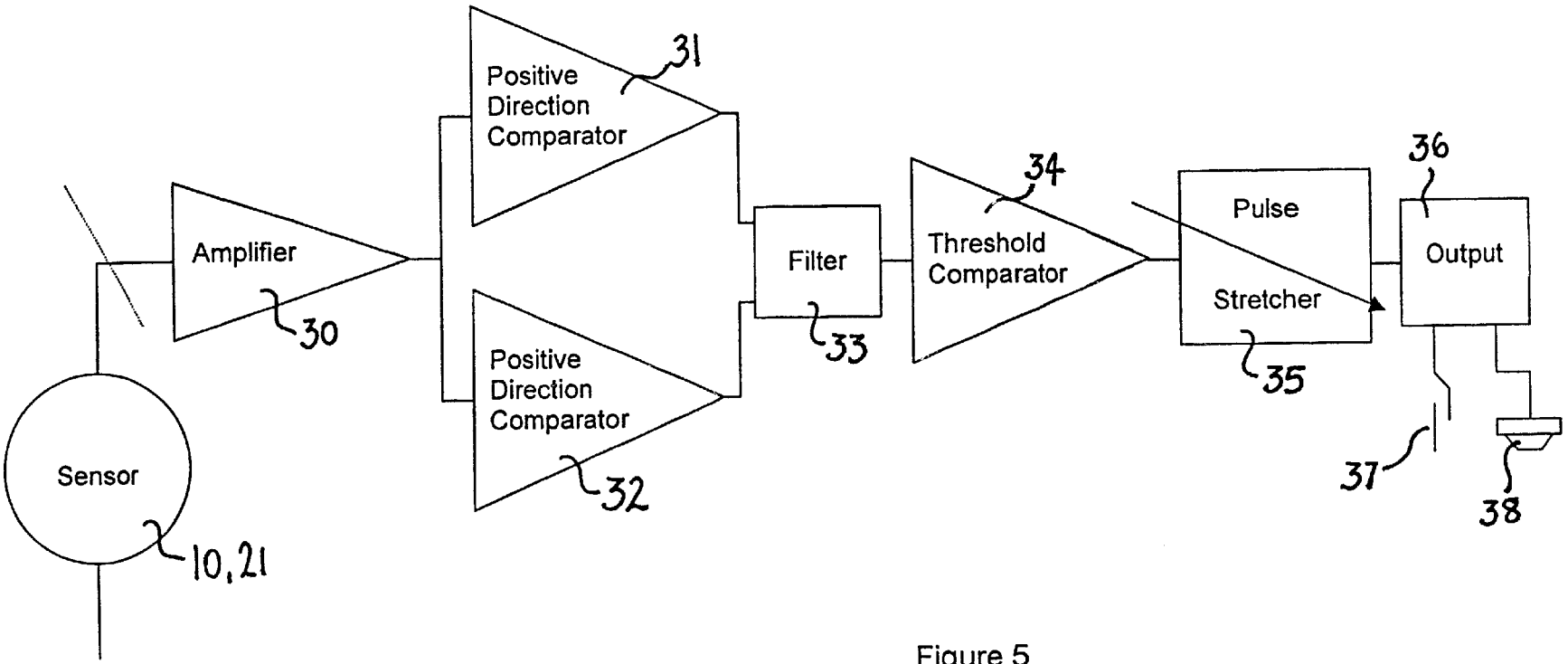
FIG. 5 shows an electronic circuit for use with either form of sensor.

As shown in FIG. 5, the electronic control circuit 15 includes an amplifier 30 which receives the output signal from the sensor 10 or 21. The amplified output is then applied, via either a positive direction comparator 31 or a negative direction comparator 32 to a slew rate limited anti-vibration low pass filter 33. The filter 33 is connected, via a threshold comparator 34, to a pulse stretcher 35 which is connected to an output 36 and thence to a relay 37 and an audible or other alarm 38, which is operated for at least a specified minimum period of time.

The slew rate limited anti-vibration low pass filter 33 is not amplitude-dependent (unlike the majority of filters) and serves to filter out all incoming signals which have a duration less than a predetermined length of time, which may be, for example, of the order of a second in length, but can be selected as required. The pulse stretcher 35 then serves to extend the length of time of the output pulse from the filter 33. If, for example, the output from the sensor 10 or 21 had a duration of 1.5 seconds, the output from the filter 33 would have a duration of 0.5 seconds and this might be multiplied by a factor of twenty by the pulse stretcher 35 to produce an output having a duration of ten seconds. All short duration pulses from the sensor 10 or 21, which might arise, for example, as a result of vibration of the wall 17 caused by a person knocking on a door, will thus be filtered out.

The electronic control circuit shown in FIG. 5 can be used not only in connection with paintings and other items hung on a wall but also for the protection of items stored or displayed on horizontal or sloping surfaces, as shown in FIGS. 6 to 8. Thus, FIGS. 6 and 7 show an arrangement in which an item 40 is positioned above a support surface 41 on which there is an electronic control circuit 15 which is arranged to receive inputs from any one of four sensors 42 each of which includes a flexible disc on which a piezoceramic element is mounted, such that movement of the item 40 out of its normal position, either towards or away from the support surface 41, will produce deflection of the disc of at least one of the sensors 42 to generate an output and initiate operation of the alarm.

FIG. 8 shows an arrangement in which an item 50 is resting on an inclined support surface 51 with its upper edge in contact with the support surface 51 and its lower edge spaced from the support surface 51. An electronic control circuit 15 is provided beneath the item 50 and is arranged to receive an input from a sensor 52 which includes a brass or other metal disc on which a piezoceramic element is mounted, such that movement of the item 50 out of its normal position, either towards or away from the support surface 51, will produce deflection of the disc of the sensor 52 to generate an output and initiate operation of the alarm.

Figure 9:
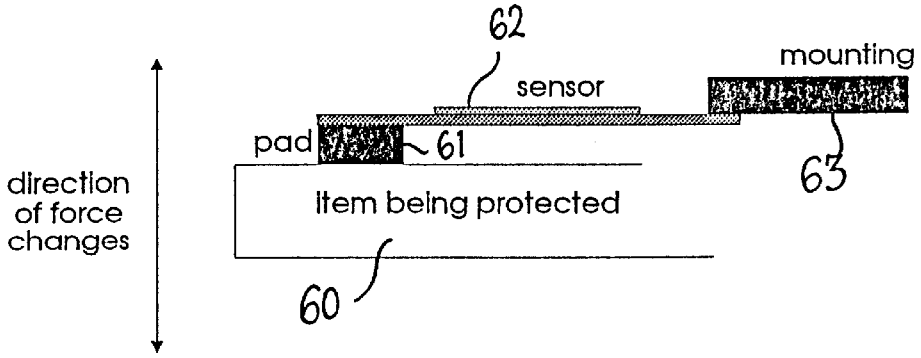
FIG. 9 shows an alternative sensor mounting arrangement, FIGS. 10*a*), *b*) and *c*) show different conditions of a further form of sensor mounting arrangement, FIGS. 11*a*), *b*) and *c*) are views from behind a painting, above a painting and to one side of a painting showing an additional form of sensor mounting arrangement, and FIGS. 12*a*), *b*) and *c*) are further views from behind a painting, above a painting and to one side of a painting showing another form of sensor mounting arrangement.

FIG. 9 shows a further arrangement in which the item 60 being protected rests against a pad 61. The pad 61 is attached to one edge of a sensor 62 which includes a brass or other metal disc on which a piezoceramic element is mounted. The opposite edge of the sensor 62 is connected to a fixed mounting 63. The arrangement is such that, in the normal position of the item 60, the disc of the sensor 62 is in a deflected condition (as described above with reference to FIGS. 3, 3A and 4) such that movement of the item 60 either towards or away from the item will produce a change in the degree of deflection of the disc and hence the generation of an output to initiate operation of an alarm.

Figure 10A:
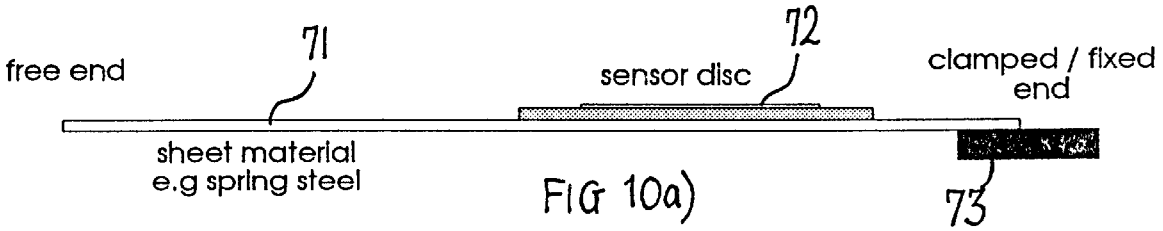
Figure 10B:
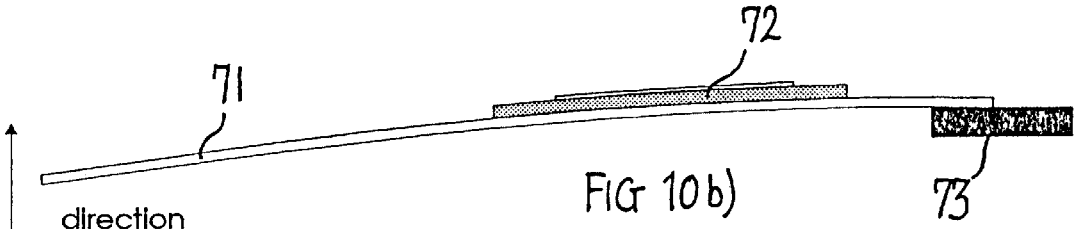
Figure 10C:
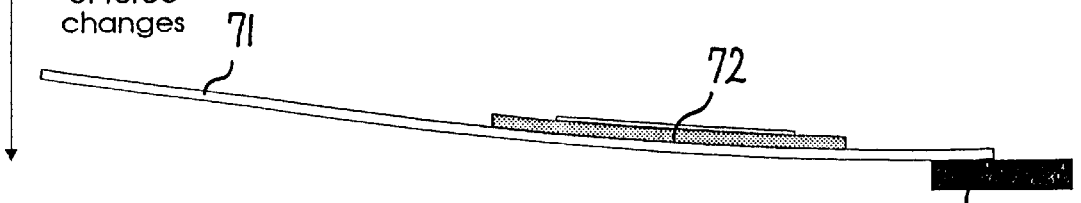

FIGS. 10*a*), *b*) and *c*) show a further arrangement in which the item to be protected is normally in engagement with the free end or edge of a strip or plate 71 of spring steel or other resilient material on which a sensor 72 is mounted. The opposite end of the spring steel strip or plate 71 is clamped or otherwise fixed to a mounting 73. The spring steel strip or plate 71 is normally in a deflected condition and the arrangement is such that, if the item is moved either towards or away from the mounting 73, the degree of deflection of the spring steel strip or plate 71 will be changed and an output will be generated.

FIGS. 11*a*), *b*) and *c*) show an arrangement similar to that of FIG. 4, except that two sensors 21 are employed, each sensor 21 including a disc 23 on which a piezoceramic element is mounted, with one edge of the disc 23 attached to the electronic control circuit 15 and a diametrically opposite edge of the disc 23 in contact with the rear of the painting 16. As shown, each disc 23 is in a deflected condition such that, any movement of the painting 16, whether towards or away from the wall on which the painting 16 is hung, will result in a change in the degree of deflection of the disc 23 and hence the generation of an output by the piezoceramic element to initiate operation of the alarm.

Figure 12A:
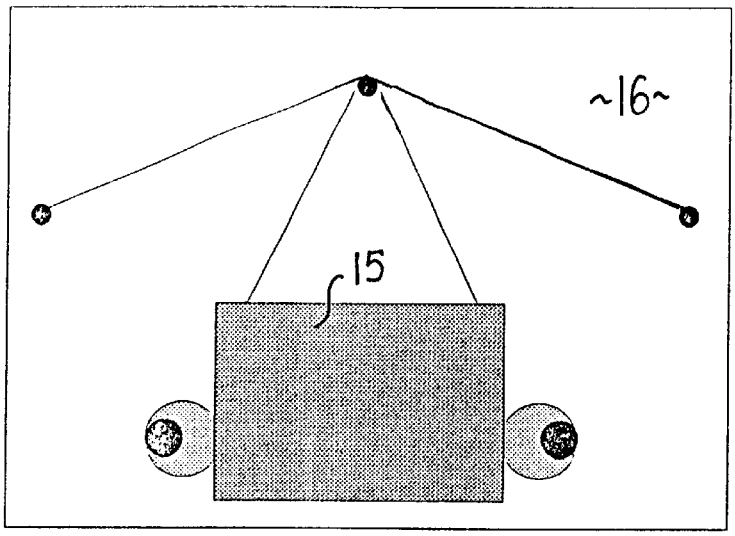
Figure 12C:
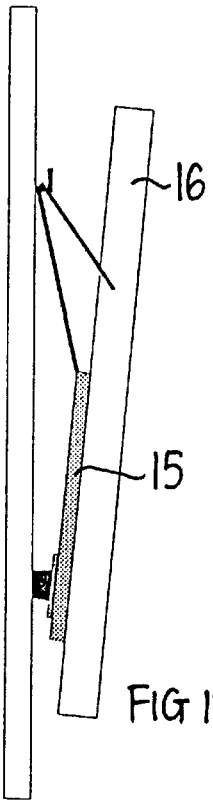
Figure 12B:
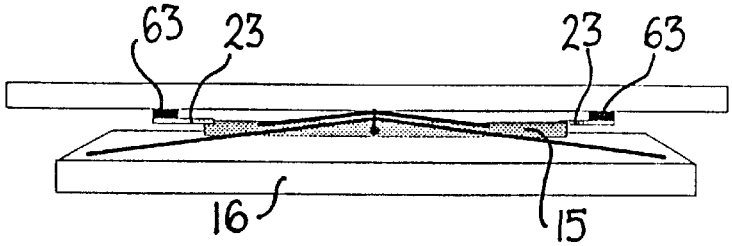

Turning next to FIGS. 12*a*), *b*) and *c*), these show an arrangement similar to FIGS. 11*a*), *b*) and *c*), where the electronic control circuit 15 is suspended from a cord between the rear of the painting 16 and the wall. The two sensor discs 23 are arranged so that one edge of each disc 23 is fixed to the electronic control circuit 15 and the diametrically opposite edge is fitted with a pad 63 which rests against the wall on which the painting 16 is hung. Each disc 23 is again in a deflected condition such that, any movement of the painting 16, whether towards or away from the wall on which the painting 16 is hung, will result in a change in the degree of deflection of the disc 23 and hence the generation of an output by the piezoceramic element to initiate operation of the alarm.

The sensor systems described above can be used in conjunction with the control circuit described in British Patent Specification No. 2 306 035, and the electronic control circuit of FIG. 5 can be used in conjunction with the sensor system described in Patent Specification No. 2 306 035.

The alarm may form part of the electronic control circuit 15. Alternatively, the alarm may be at a remote location with a signal transmitted to the alarm by means of an induction loop device.

What is claimed is:

1. A security alarm system for use in detecting movement of an item suspended from a wall or other substantially vertical structure, or for detecting movement of an item displayed or stored on a horizontal or inclined surface, said security alarm system comprising a sensor system including a piezoceramic element which is mounted on a plate which, in use, is located between the item and the structure or surface, and means for detecting the generation of an output by the piezoceramic element as a result of deflection of the plate in either of two opposite directions as a result of movement of the item, a processing circuit for processing the output from the sensor system, and an alarm, the processing circuit including a slew rate limited anti-vibration low pass filter for differentiating between true alarm and false alarm signals.

2. A security alarm system as claimed in claim 1, in which the plate has a first edge portion which is attached to a mounting and is bent out of the plane of the remainder of the plate, the plate being positioned so that a second edge portion, diametrically opposite to the first edge portion, is in contact with the item.

3. A security alarm system as claimed in claim 1, in which the plate is in the form of a brass or other metal disc which is attached at its one edge to a mounting and has its diametrically opposite edge in engagement with a pad fixed to or in contact with the item, with the arrangement such that the disc is caused to deflect and an output is generated by the piezoceramic element in response to movement of the item in either direction.

4. A security alarm system as claimed in claim 1, in which the plate is in the form of a disc which is mounted on a resiliently deformable metal strip or plate, such that a part of the strip or plate is in contact with the item, with the arrangement such that the strip or plate is caused to deflect, and will transmit such deflection to the disc, in response to movement of the item in either direction and an output will be generated by the piezoceramic element.

5. A sensor system for detecting movement of an item suspended from a wall or other substantially vertical structure, the sensor system including a piezoceramic element fixed to one side of a plate and a permanent magnet fixed to the other side of the plate.

6. A sensor system as claimed in claim 5, in which the plate is in the form of a brass or other metal disc that is mounted within a housing in such manner that the periphery, or a portion of the periphery, of the disc is clamped while the centre portion or remainder of the disc is free to move.

7. A sensor system as claimed in claim 5, in which the piezoceramic element is in a pre-stressed state when the system is fitted to the item being protected.

8. A security alarm system which includes a sensor system as claimed in claim 5 for generating an output, a processing circuit for processing the output from the sensor system, and an alarm, the processing circuit including a slew rate limited anti-vibration low pass filter for differentiating between true alarm and false alarm signals.

9. A security alarm system as claimed in claim 8, in which the slew rate limited anti-vibration low pass filter is arranged to filter out signals which have a duration less than a predetermined length of time and is arranged in series with a pulse stretcher to ensure that the length of time for which the alarm is operated is greater than the length of time for which an output is generated by the slew rate limited anti-vibration low pass filter.

10. A security alarm system as claimed in claim 9, in which the alarm forms part of a unit which, in the case of a wall-hung item, is located between the item and the wall.

11. A security alarm system as claimed in claim 9, in which the alarm is at a location remote from the item and a signal is transmitted to the alarm by means of an induction loop device.

* * * * *